US009976329B1

(12) United States Patent
Lucci et al.

(10) Patent No.: US 9,976,329 B1
(45) Date of Patent: May 22, 2018

(54) ADJUSTABLE CARRIAGE ASSEMBLY FOR SUSPENDING A PANEL

(71) Applicant: Caldwell Manufacturing Company North America, LLC, Rochester, NY (US)

(72) Inventors: Robert M. Lucci, Rochester, NY (US); Jay DeSormeau, Churchville, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days. days.

(21) Appl. No.: 15/587,886

(22) Filed: May 5, 2017

(51) Int. Cl.
*E05D 15/26* (2006.01)
*E05D 15/06* (2006.01)

(52) U.S. Cl.
CPC ..... *E05D 15/26* (2013.01); *E05D 15/0634* (2013.01); *Y10T 16/3834* (2015.01)

(58) Field of Classification Search
CPC . E05D 15/26; E05D 15/0634; E05D 15/0669; E05D 7/0027; E05D 7/0423; E05Y 2201/64; E05Y 2600/20; Y10T 16/3834; Y10T 16/35; Y10T 16/3825; Y10T 16/5325; Y10T 16/53253; Y10T 16/5327
USPC ..... 16/105, 87 R, 102, 244, 245, 248; 49/156
See application file for complete search history.

(56) References Cited

U.S. PATENT DOCUMENTS

| | | | | |
|---|---|---|---|---|
| 3,492,687 | A * | 2/1970 | Herr | B61D 19/009 16/105 |
| 6,618,900 | B2 | 9/2003 | Spork et al. | |
| 7,246,412 | B2 | 7/2007 | Pacholke | |
| 8,522,398 | B2 * | 9/2013 | Haab | E05D 15/0634 16/102 |
| 8,677,564 | B2 | 3/2014 | Pelekanos | |
| 8,695,165 | B2 | 4/2014 | Pelekanos | |
| 9,009,918 | B2 * | 4/2015 | Haab | E05D 15/0652 16/105 |
| 9,032,589 | B2 | 5/2015 | Pelekanos | |
| 9,157,265 | B2 | 10/2015 | Pelekanos | |
| 9,157,267 | B2 | 10/2015 | Pelekanos | |
| 2013/0061427 | A1 * | 3/2013 | Lang | E05D 7/0423 16/248 |
| 2015/0368949 | A1 | 12/2015 | Smith | |
| 2016/0024826 | A1 | 1/2016 | Smith | |

* cited by examiner

*Primary Examiner* — William L Miller
(74) *Attorney, Agent, or Firm* — Harness, Dickey & Pierce, P.L.C.

(57) ABSTRACT

An adjustable carriage assembly includes a body; a hinge pin disposed in a threaded first bore of the body, the hinge pin having a threaded end and a first longitudinal axis; a lock post disposed in a second bore of the body, the lock post having a second longitudinal axis; a torsion spring disposed around the lock post; and a retention pin disposed in a third bore of the body to retain the lock post in the second bore. A first extension portion of the lock post engages a flat portion of the hinge pin in a locked state. The lock post is operable to rotate about the second longitudinal axis to disengage the first extension portion from the flat portion and place the carrier assembly in an unlocked state so that the hinge pin is free to rotate and move longitudinally within the first bore.

22 Claims, 9 Drawing Sheets

ADJUSTABLE CARRIAGE ASSEMBLY FOR SUSPENDING A PANEL

FIELD

The present disclosure relates to vertically-hanging, foldable barriers, and more particularly to an adjustable carriage assembly for a vertically-hanging panel of a foldable barrier.

BACKGROUND

This section provides background information related to the present disclosure which is not necessarily prior art.

Vertically-hanging, foldable barriers can include doors, walls, screens, shutters, and partitions, each having multiple sections or panels joined together and adjacent to one another to form a barrier that can be opened and closed by folding or stacking the panels against one another. Hinge hardware can be installed between adjacent panels to allow them to rotate relative to one another to facilitate opening and closing the barrier. The hinge hardware may be connected to a carriage or buggy assembly to facilitate vertically-hanging a panel. The carrier assembly may be adjustable so that the height of a panel with respect to an overhead track can be adjusted or modified.

SUMMARY

This section provides a general summary of the disclosure, and is not a comprehensive disclosure of its full scope or all of its features.

In one aspect of the present disclosure, an adjustable carriage assembly for a vertically-hanging panel of a foldable barrier is described. The carrier assembly can include a body, a hinge pin, a lock post, a torsion spring, and a retention pin. The body can include a lower surface and a side surface adjacent to the lower surface. The lower surface may include a threaded first bore, a second bore having an inner surface, and a recess that is adjacent to the first bore and the second bore. The second bore can include a counterbore having a first portion with a first diameter and a second portion with a second diameter. The first diameter can be larger than the second diameter. The side surface can include a third bore.

The hinge pin can include a shaft extending along a first longitudinal axis and having a threaded terminal end. The threaded terminal end can comprise at least one flat portion substantially parallel to the first longitudinal axis.

The lock post can include a base having a first surface, a second surface substantially perpendicular to the first surface, and a third surface substantially perpendicular to the first surface and substantially parallel to the second surface. The lock post can also include a first extension portion extending from the first surface of the base. The first extension portion can be adjacent to and integrally formed with the base. The lock post can further include a substantially cylindrical second shaft or extension portion extending along a second longitudinal axis that can be substantially parallel to the first longitudinal axis. The second shaft or extension portion can be adjacent to and integrally formed with the base. The second shaft or extension portion can include a fourth surface. The fourth surface can include a receiver. The receiver can be a groove that extends at least partially around the circumference of the second shaft. The third surface can include a receptacle. The receptacle can be a socket having a hexagonal cross section that is operable to receive a tool.

The torsion spring can have a fixed end and a free end. The fixed end can engage the inner surface of the second bore. The free end can engage the first extension portion of the lock post. The torsion spring can be disposed around the second extension portion of the lock post.

The base of the lock post can be at least partially disposed in the first portion of the second bore. The second extension portion of the lock post can be at least partially disposed in the second portion of the second bore. The first extension portion of the lock post can be at least partially disposed in the recess. The retention pin can be at least partially disposed in the third bore. A first end of the retention pin can engage the receiver of the lock post to retain the lock post in the second bore.

The carriage assembly may be provided in a locked state or an unlocked state. In a locked state, the torsion spring is in a free state and the first extension portion of the lock post engages the at least one flat portion of the hinge pin. The lock post is operable to rotate about the second longitudinal axis. Rotation of the lock post energizes the torsion spring and disengages the first extension portion of the lock post from the at least one flat portion of the hinge pin to place the carriage assembly in an unlocked state. In an unlocked state, the hinge pin is free to rotate so as to move longitudinally within the first bore.

In another aspect of the present disclosure, the carriage assembly can include a body, a hinge pin, a lock post, and a retention pin. The body can include a lower surface and a side surface. The lower surface can include a threaded first bore, a second bore having an inner surface, and a recess that is adjacent to the first bore and the second bore. The side surface can include a third bore. The hinge pin can include a shaft extending along a first longitudinal axis, and a threaded terminal end. The threaded terminal end can comprise at least one flat portion that is substantially parallel to the first longitudinal axis. The lock post can include a base, a first extension portion adjacent to the base, and a substantially cylindrical second shaft or extension portion adjacent to the base. The second shaft or extension portion can extend along a second longitudinal axis. The second shaft of extension portion can include a fourth surface defining a receiver.

The second shaft or extension portion of the lock post can be at least partially disposed in the second bore and the first extension portion of the lock post can be at least partially disposed in the recess. The retention pin can be at least partially disposed in the third bore and a first end of the retention pin can engage the receiver of the lock post to retain the lock post in the second bore. The threaded terminal end of the hinge pin can be at least partially disposed in the first bore.

In a locked state, the first extension portion of the lock post may engage the at least one flat portion of the hinge pin. The locked post may be operable to rotate about the second longitudinal axis. Rotation of the lock post may disengage the first extension portion of the lock post from the at least one flat portion of the hinge pin to place the carriage assembly in an unlocked state. In an unlocked state, the hinge pin may be free to rotate so as to move along the first longitudinal axis within the first bore.

The receiver may comprise a groove extending at least partially around the circumference of the second shaft.

The carriage assembly may further include a torsion spring disposed around the second shaft or extension portion of the lock post. The torsion spring may include a fixed end and a free end. The fixed end may engage an inner surface of the second bore and the free end may engage the first extension portion of the lock post. The torsion spring may be in a free state when the carriage assembly is in a locked state. Rotation of the lock post about the second longitudinal axis may energize the torsion spring.

The inner surface of the second bore may include a second groove. The fixed end of the torsion spring may engage the second groove. The fixed end of the torsion spring may remain substantially fixed to the base during rotation of the lock post about the second longitudinal axis. The first extension portion may include a third groove. The free end of the torsion spring may engage the third groove. The free end of the torsion spring may remain substantially fixed to the lock post during rotation of the lock post about the second longitudinal axis, so that the free end of the torsion spring rotates together with the first extension portion of the lock post.

The second bore may comprise a counterbore. The counterbore may include a first portion having a first diameter and a second portion having a second diameter. The first diameter may be larger than the second diameter. The second extension portion of the lock post may be at least partially disposed in the second portion of the counterbore and the base of the lock post may be at least partially disposed in the first portion of the counterbore.

The base of the lock post may include a first surface, a second surface substantially perpendicular to the first surface, and a third surface substantially perpendicular to the first surface and substantially parallel to the second surface. The first extension portion may extend from the first surface and the second extension portion may extend from the second surface. The third surface may include a receptacle. The receptacle may be a socket having a hexagonal cross section. The first extension portion of the lock post may include a fifth surface and a sixth surface. The fifth surface and the sixth surface may form an angle. The angle may be greater than or equal to about forty-five (45) degrees and less than or equal to about ninety (90) degrees.

In still other aspects of the present disclosure, another adjustable carriage assembly for a vertically-hanging panel of a foldable barrier is provided. The carriage assembly can include a body, a hinge pin, and a lock post. The body can include a lower surface, a threaded first bore included in the lower surface, a second bore included in the lower surface, and a recess included in the lower surface. The recess may be adjacent to the first bore and the second bore. The hinge pin may include a first shaft, a threaded terminal end, and a first longitudinal axis extending through the center of the first shaft. The threaded terminal end may comprise at least one groove substantially parallel to the first longitudinal axis. The lock post may include a base and a second shaft. The base may include a pawl. The second shaft may include a second longitudinal axis extending through the center of the shaft. The second shaft is adjacent to the base.

The second shaft of the lock post may be at least partially disposed in the second bore. The pawl may be at least partially disposed in the recess. The lock post may be longitudinally fixed within the second bore. The threaded terminal end of the hinge pin may be at least partially disposed in the first bore. The pawl of the lock post may engage the groove of the hinge pin when the carriage assembly is in a locked state. The lock post may be operable to rotate about the second longitudinal axis. Rotation of the lock post may disengage the pawl of the lock post from the groove of the hinge pin to place the carriage assembly in an unlocked state.

The carriage assembly may further comprise a torsion spring disposed around the second shaft of the lock post. The torsion spring may comprise a fixed end and a free end. The fixed end engages an inner surface of the second bore. The free end engages the lock post. The torsion spring is in a free state when the carriage assembly is in a locked state. Rotation of the lock post about the second longitudinal axis may energize the torsion spring. The lock post may further comprise an extension portion. The free end of the torsion spring may engage the extension portion of the lock post. The pawl may be shaped to complement the groove of the hinge pin.

The groove of the hinge pin may comprise a back surface, a first side surface adjacent to the back surface, and a second side surface adjacent to the back surface. The back surface and the first side surface may form a first angle. The back surface and the second side surface may form a second angle. The pawl may comprise an end surface, a third side surface adjacent to the end surface, and a fourth side surface adjacent to the end surface. The third side surface may be operable to engage the first side surface when the carriage assembly is in a locked state. The fourth side surface may be operable to engage the second side surface when the carriage assembly is in a locked state. The end surface and the third side surface may form a third angle. The end surface and the fourth side surface may form a fourth angle. The first angle and the third angle may be acute. The second angle may be acute and the fourth angle may be acute. The magnitude of the first angle may be substantially equal to the magnitude of the third angle. The first side surface and the third side surface may be substantially parallel when the carriage assembly is in a locked state.

The carriage assembly may further comprise a retention pin. The retention pin may be at least partially disposed in a third bore of a side surface of the body adjacent to the lower surface. The retention pin may engage a receiver of the lock post to retain the lock post in the second bore.

The base of the lock post may further comprise an extension portion including a protrusion. The recess of the base may include a receptacle shaped to complement the protrusion. The protrusion may be operable to engage the receptacle when the carriage assembly is in a locked state. One of the protrusion or the receptacle may include at least one raised portion. The at least one raised portion may be operable to create an interference fit between the protrusion and the receptacle when the carriage assembly is in a locked state.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 3A:
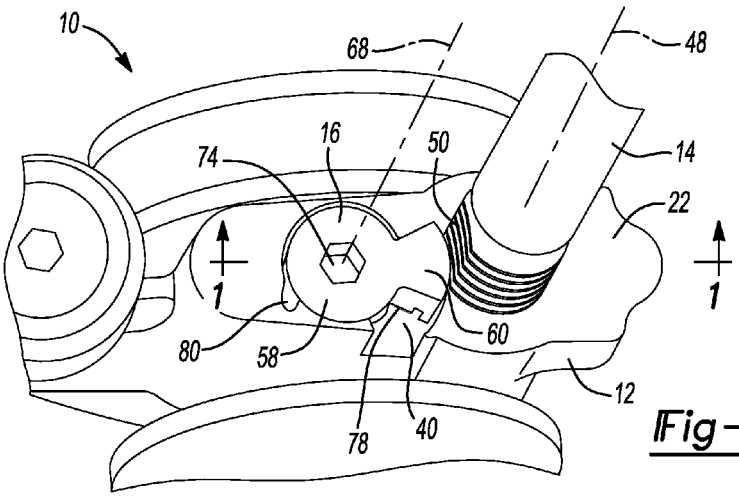
Figure 3B:
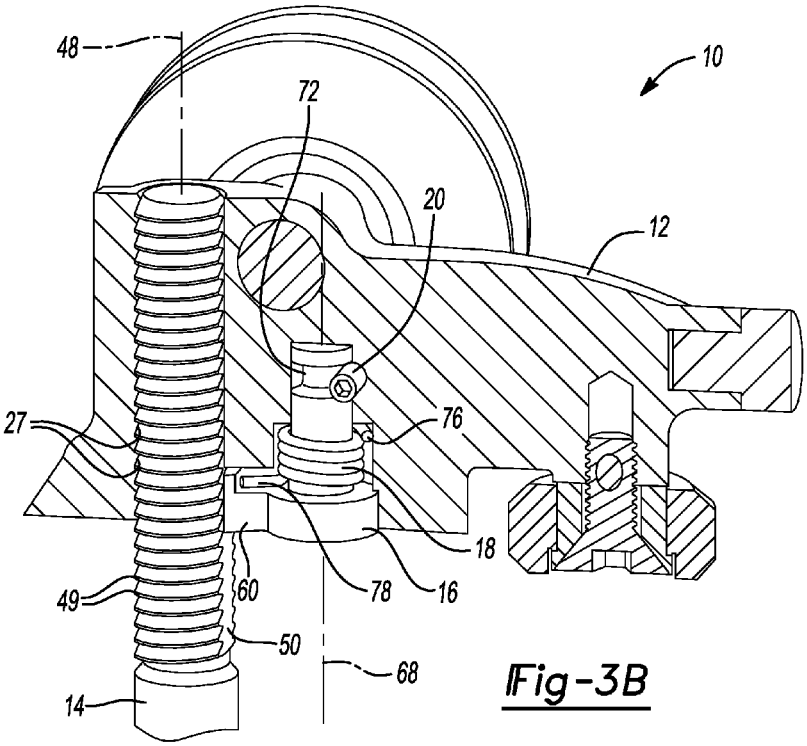
Figure 4A:
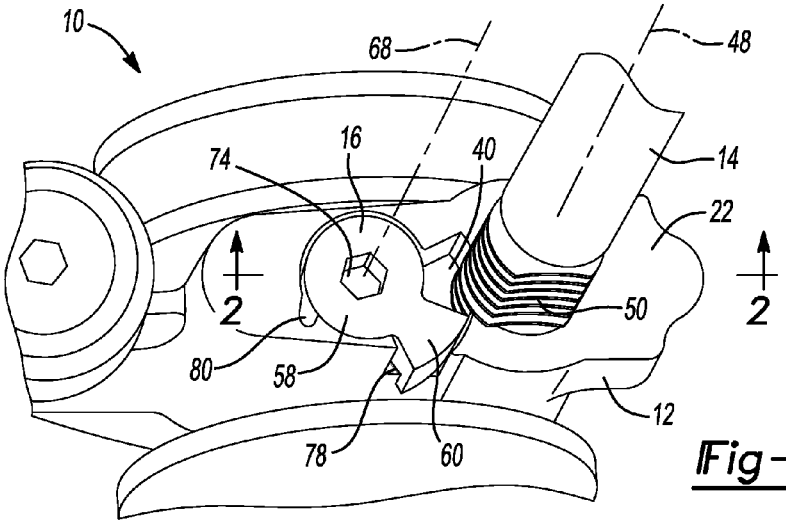
Figure 4B:
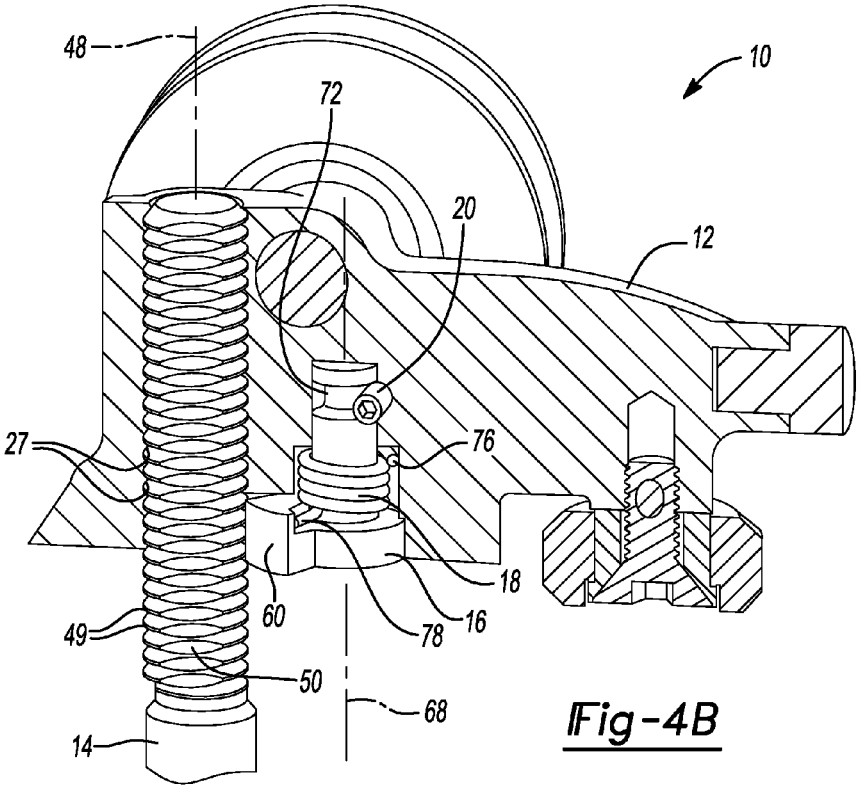
Figure 5:
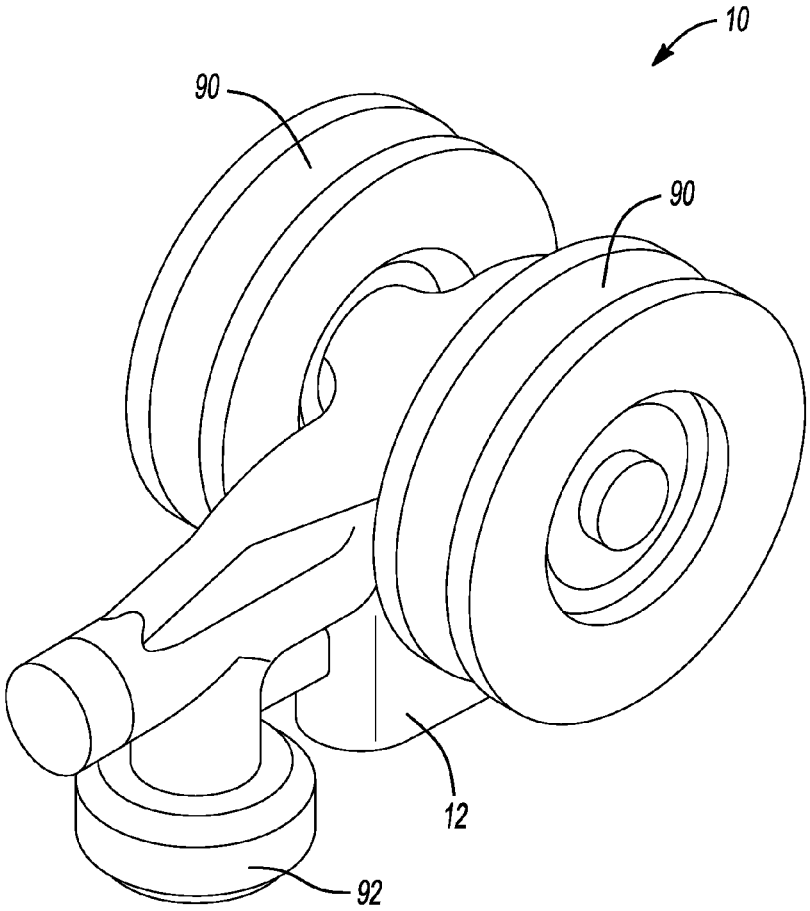
Figure 6A:
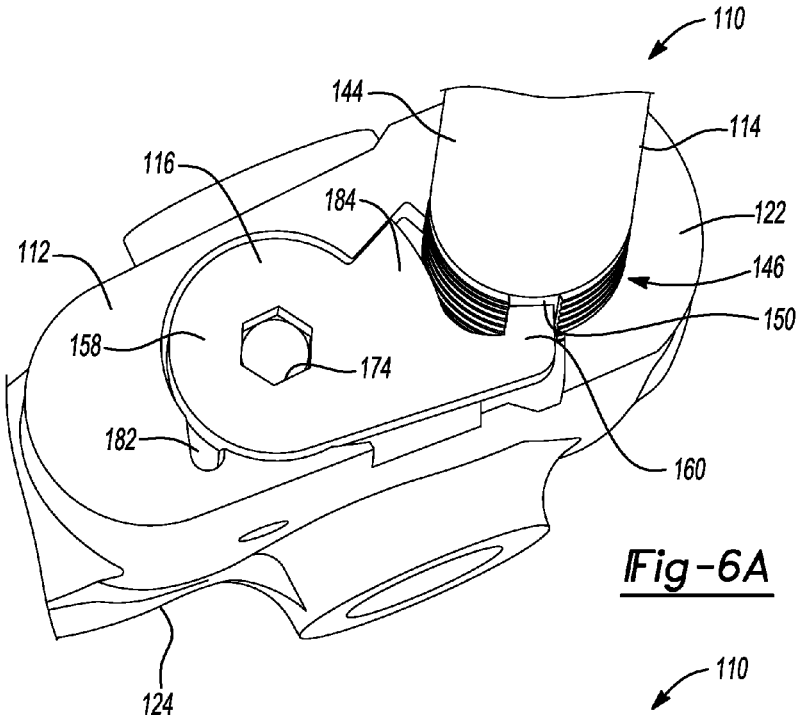
Figure 6B:
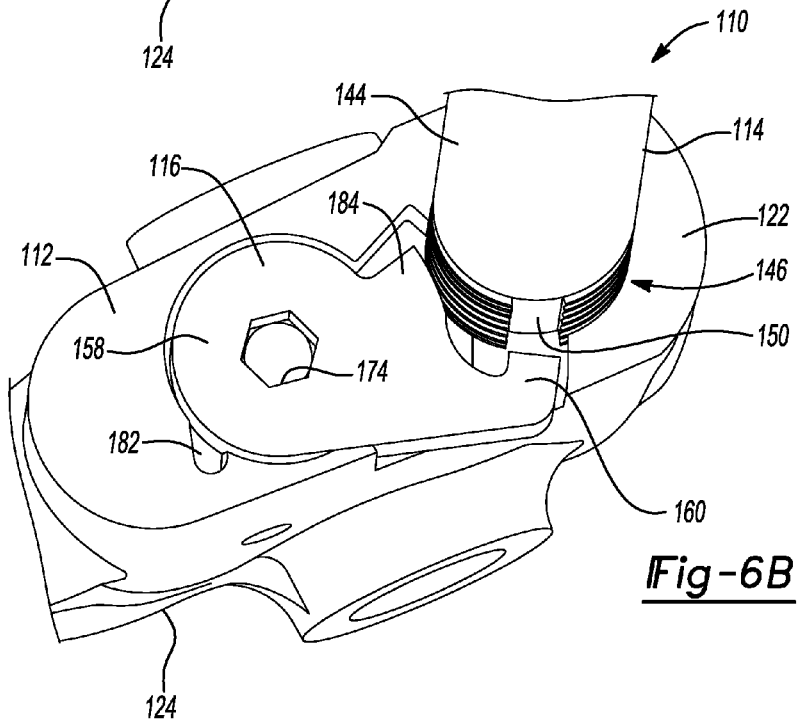
Figure 7:
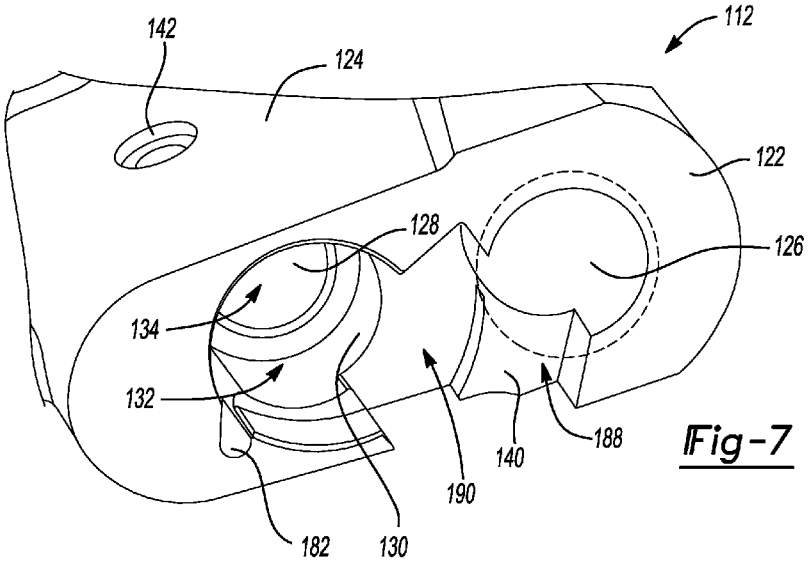
Figure 8:
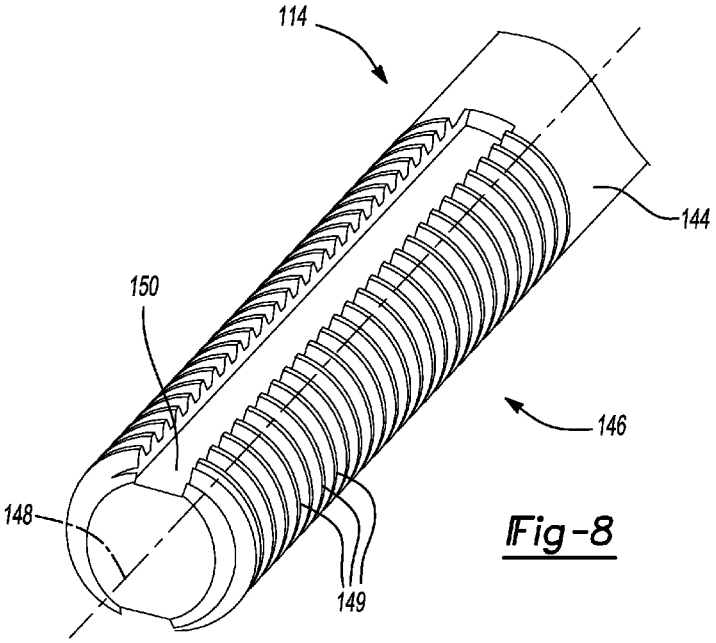
Figure 9:
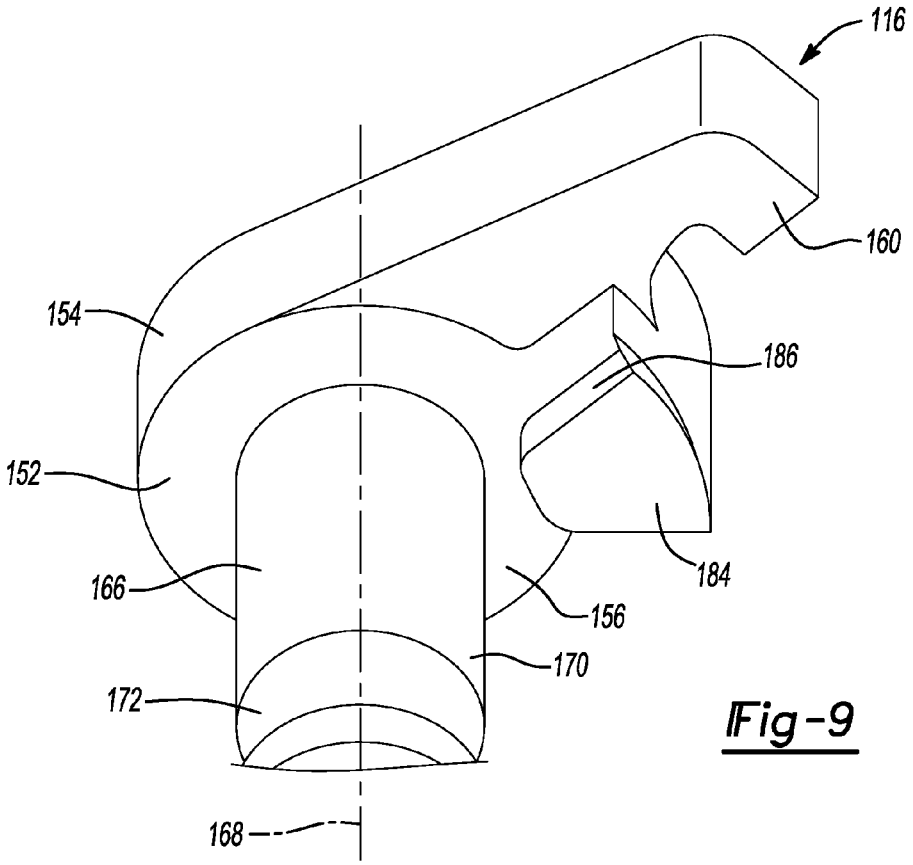
Figure 10:
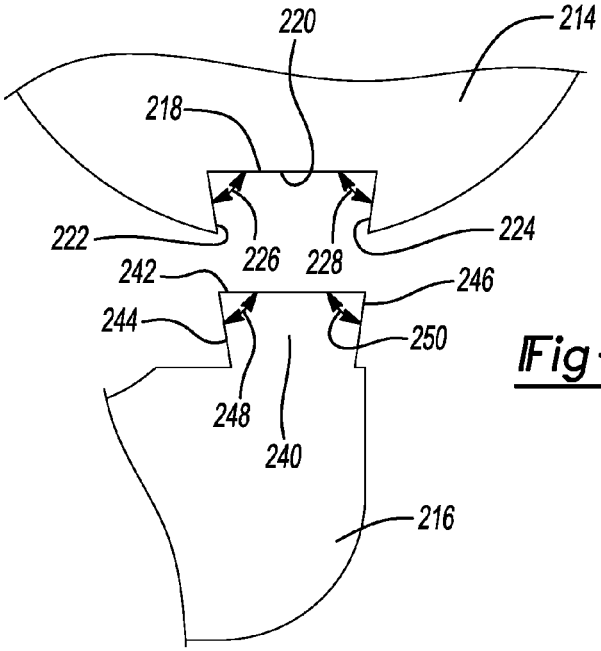
Figure 11:
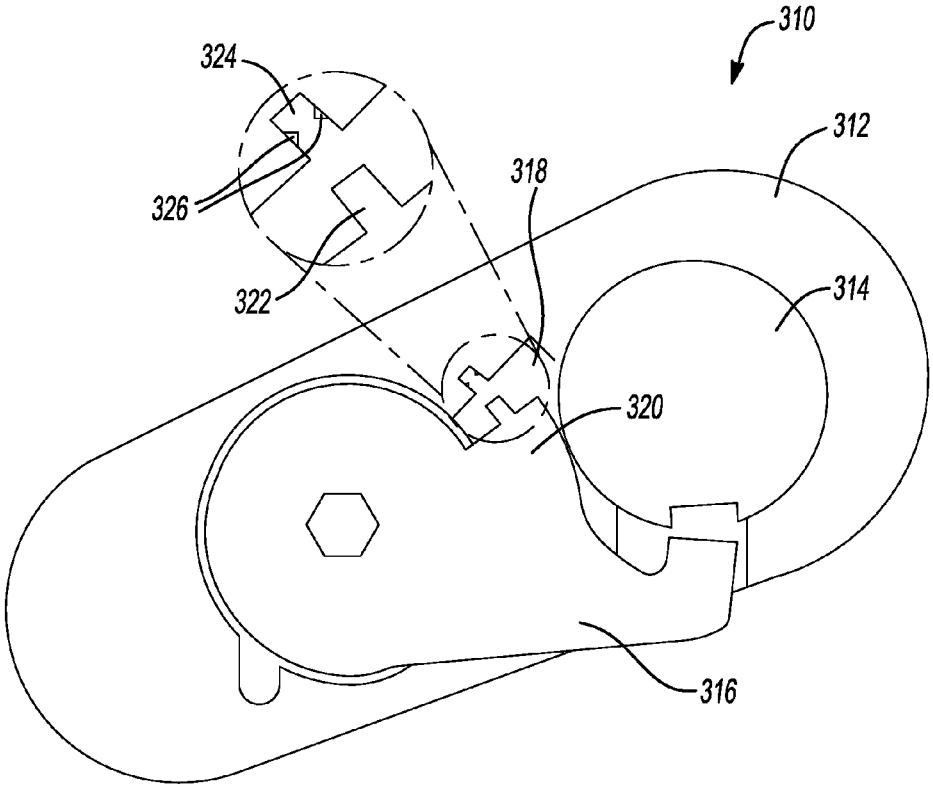

FIGS. 3A-3B show enlarged detail views of a carriage assembly in a locked state according to certain aspects of the present disclosure; FIG. 3A shows a partial perspective view of the underside of a carriage assembly in a locked state; FIG. 3B shows a view of the carriage assembly of FIG. 3A with the body in cross-section along the line 1-1 of FIG. 3A;

FIGS. 4A-4B show enlarged detail views of a carriage assembly in an unlocked state according to certain aspects of the present disclosure; FIG. 4A shows a partial perspective view of the underside of a carriage assembly in an unlocked state; FIG. 4B shows a view of the carriage assembly of FIG. 4A with the body in cross-section along the line 2-2 of FIG. 4A;

FIG. 5 shows a perspective view of a carriage assembly including wheels and a guide according to certain aspects of the present disclosure;

FIGS. 6A-6B show enlarged detail views of an adjustable carriage assembly according to certain aspects of the present disclosure; FIG. 6A shows a partial perspective view of the underside of a carriage assembly in a locked state; FIG. 6B shows a partial perspective view of the underside of the carriage assembly in an unlocked state;

FIG. 7 shows a partial perspective view of a body of the carriage assembly of FIG. 6A;

FIG. 8 shows a partial perspective view of a hinge pin of the carriage assembly of FIG. 6A;

FIG. 9 shows a partial perspective view of a lock post of the carriage assembly of FIG. 6A;

FIG. 10 shows a partial exploded bottom view of a hinge pin and a lock post of a carriage assembly according to certain aspects of the present disclosure; and FIG. 11 shows a bottom view of a carriage assembly having an interference fit between a base and a lock post according to certain aspects of the present disclosure.

Corresponding reference numerals indicate corresponding parts throughout the several views of the drawings.

DETAILED DESCRIPTION

Example embodiments will now be described more fully with reference to the accompanying drawings.

Figure 1:
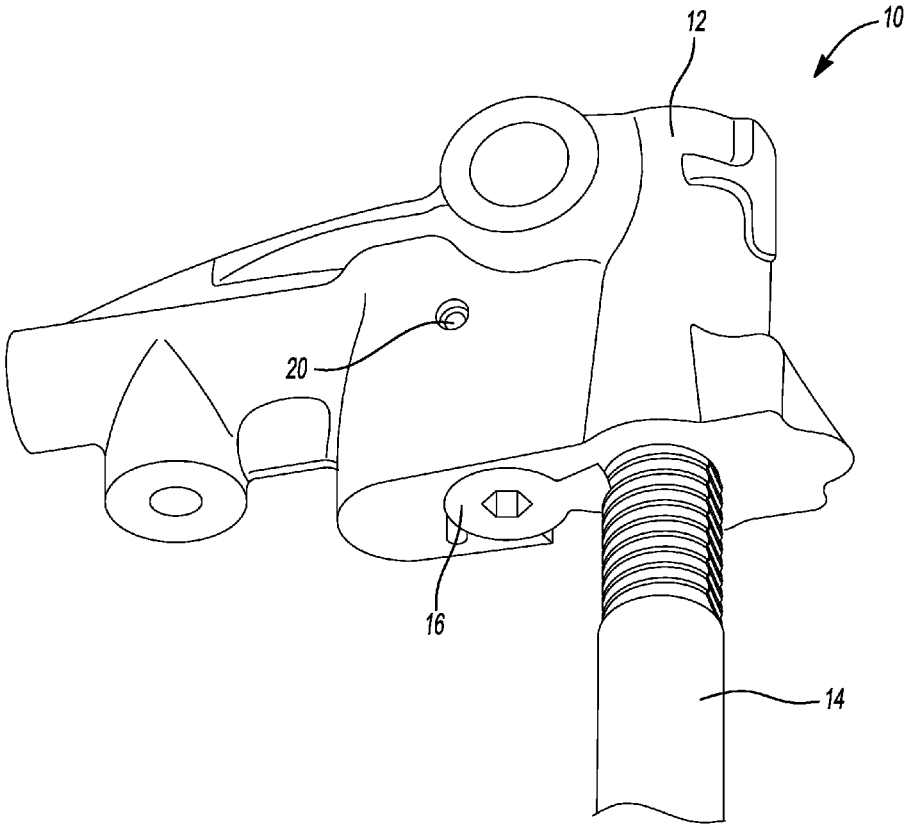
FIG. 1 is a partial perspective view of an adjustable carriage assembly according to the principles of the present disclosure.
Figure 2:
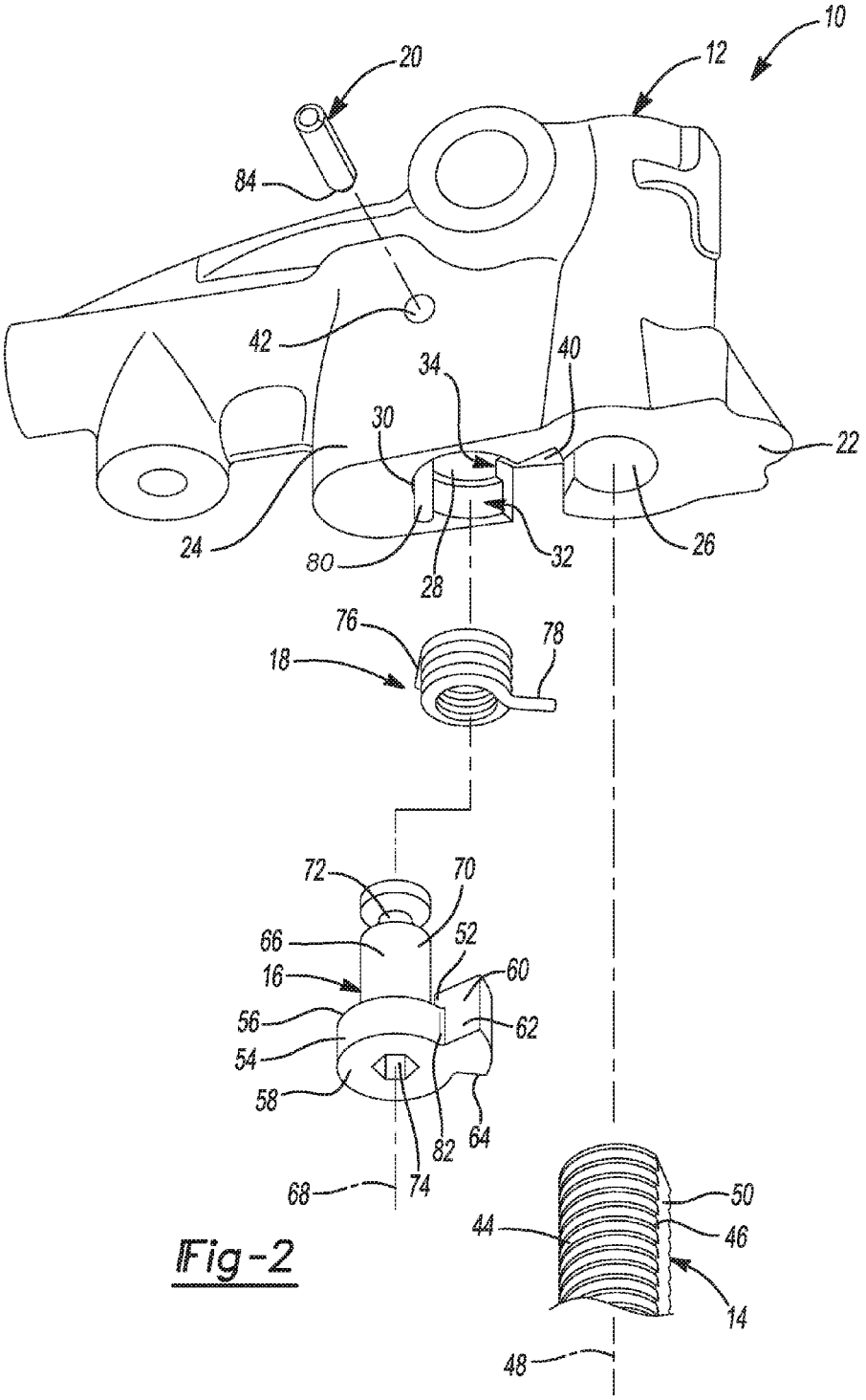
FIG. 2 is a partial exploded perspective view showing a disassembled base, hinge pin, lock post, torsion spring, and retention pin of an adjustable carriage assembly according to the principles of the present disclosure.

An adjustable height overhead carriage assembly for a vertically-hanging panel of a foldable barrier according to the principles of the present disclosure is illustrated in FIGS. 1-2. As shown in the figures, an adjustable carriage or buggy assembly 10 can generally include a body 12, a hinge pin 14, a lock post 16, a torsion spring 18, and a retention pin 20. With reference to FIG. 2, an exploded perspective view of the carriage assembly 10 is illustrated with the hinge pin 14, the lock post 16, the torsion spring 18, and the retention pin 20 disassembled from the body 12.

Referring to FIG. 2, the body 12 may include a first or lower surface 22 and a second or side surface 24 that may be adjacent to the lower surface 22. In certain embodiments, the side surface 24 can be substantially perpendicular to the lower surface 22. A first bore 26 may be included in the lower surface 22. The first bore 26 may include female threads 27 (see FIGS. 3B and 4B). A second bore or cavity 28 may further be included in the lower surface 22. The second bore 28 may comprise a third or inner surface 30. The second bore 28 may be a counterbore comprising a first portion 32 and a second portion 34. The first portion 32 has a first diameter and the second portion 34 has a second diameter. The first diameter may be larger than the second diameter. The lower surface 22 may further include a recess 40. The recess 40 may be adjacent to the first bore 26 and the second bore 28. The side surface 24 of the body 12 may include a third bore 42.

The hinge pin 14 may include a shaft 44, a threaded terminal end 46, and a first longitudinal axis 48 extending through the center of the shaft 44. The threaded terminal end 46 may include male threads 49 and at least one flat portion 50 that is substantially parallel to the first longitudinal axis 48. The at least one flat portion 50 may comprise a pair of opposed flat portions. However, other numbers of flat portions are contemplated and are within the scope of the present disclosure. The threaded terminal end 46 of the hinge pin 14 may be at least partially disposed in the first bore 26. The male threads 49 of the threaded terminal end 46 may engage the female threads 27 of the first bore 26 to retain the hinge pin 14 in the first bore 26.

The lock post 16 may include a base 52 comprising a first or exterior side surface 54, a second or exterior top surface 56, and a third or exterior bottom surface 58. The first surface 54 may be adjacent to the second surface 56 and the third surface 58 may be adjacent to the first surface 54. In certain embodiments, the second surface 56 may be substantially perpendicular to the first surface 54, and the third surface 58 may be substantially perpendicular to the first surface 54 and substantially parallel to the second surface 56. The lock post 16 may include a first extension or key portion 60 extending from the first surface 54 of the base 52. The first extension portion 60 may be adjacent to the base 52. In certain embodiments, the first extension portion 60 may be integrally formed with the base 52. The first extension portion 60 may have opposing side surfaces including a fifth or exterior side surface 62 and a sixth or exterior side surface 64. The fifth surface 62 and the sixth surface 64 may form an angle so that the first extension portion 60 has a substantially pie-shaped or wedge-shaped cross-section. In certain embodiments, the angle may be greater than about zero (0) degrees and less than about one hundred eighty (180) degrees. In certain other embodiments, the angle may be greater than or equal to about forty-five (45) degrees and less than or equal to about ninety (90) degrees.

The lock post 16 may further include a second extension portion or shaft 66. In certain embodiments, the second extension portion 66 may be substantially cylindrical. The second extension portion 66 may extend from the second surface 56 of the base 52, and be adjacent to and the base 52. In certain embodiments, the second extension portion 66 may be integrally formed with the base 52. The second extension portion 66 includes a second longitudinal axis 68 extending through its center. The second extension portion 66 may include a fourth or exterior surface 70 and a receiver 72 provided in the fourth surface 70. In certain embodiments, the receiver 72 may comprise a circumferential first groove. In certain other embodiments, the receiver 72 may comprise a partial circumferential groove. The lock post 16 may further include a receptacle 74 in the third surface 58 of the base 52. The receptacle 74 may be a socket having a hexagonal cross section to receive a tool, such as a hex wrench, by way of non-limiting example. However, other shapes of receptacle and associated tools are contemplated and are within the scope of the present disclosure.

The torsion spring 18 may have a fixed end 76 (best shown in FIGS. 3B and 4B) and a free end 78. The torsion spring 18 may be disposed around of the second extension portion 66 of the lock post 16.

The base 52 of the lock post 16 may be at least partially disposed in the first portion 32 of the second bore 28. The second extension portion 66 of the lock post 16 may be at least partially disposed in the second portion 34 of the second bore 28. The first extension portion 60 may be at least partially disposed in the recess 40.

The fixed end 76 of the torsion spring 18 may engage the inner surface 30 of the second bore 28. In certain embodiments, the inner surface 30 of the second bore 28 may include a second groove 80 to accommodate the fixed end 76 of the torsion spring 18. The free end 78 of the torsion spring 18 may engage the first extension portion 60 of the lock post 16. In certain embodiments, the fifth surface 62 of the first extension portion 60 includes a third groove 82 (best seen in FIG. 2) to accommodate the free end 78 of the torsion spring 18.

The retention pin 20 may be at least partially disposed in the third bore 42. A first end 84 of the retention pin 20 may engage the receiver 72 of the lock post 16 to retain the lock post 16 within the second bore 28.

The carriage assembly 10 may be provided in a locked state or an unlocked state. Referring to FIGS. 3A-3B, in the locked state, the first extension portion 60 of the lock post 16 engages the at least one flat portion 50 of the hinge pin 14, thereby impeding rotation of the hinge pin 14 about the first longitudinal axis 48 and fixing the longitudinal height of the hinge pin 14. The torsion spring 18 is in a free state when the carriage assembly 10 is in a locked state. Therefore, absent the application of torque to the lock post 16, the lock post 16 is biased toward the locked state.

Referring to FIGS. 4A-4B, the carriage assembly 10 can be placed in the unlocked state by rotation the lock post 16 about the second longitudinal axis 68. Rotation can be enabled by a tool (not shown) that can engage the receptacle 74 of the lock post 16. Rotation of the lock post 16 places the torsion spring 18 in an energized state. Rotation of the lock post 16 disengages the first extension portion 60 of the lock post 16 from the at least one flat portion 50 of the hinge pin 14. In the unlocked state, the hinge pin 14 is free to rotate about the first longitudinal axis 48. Such rotation allows longitudinal movement of the hinge pin 14 in the longitudinal direction within the first bore 26, thereby allowing respective vertical movement of the hinge and hanging panel to which the carriage assembly 10 is attached.

Referring to FIG. 5, in certain variations, the carriage assembly 10 may further include a pair of wheels 90 and a guide 92 attached to the body 12. The pair of wheels 90 may engage an overhead track (not shown). The guide 92 may be disposed between two side walls of an overhead track (not shown) to reduce latitudinal movement of the carriage assembly 10 with respect to the overhead track.

In certain other variations, the carriage assembly 10 may be provided without a torsion spring. The carriage assembly may include a body, a hinge pin, a lock post, and a retention pin, similar to the body 12, hinge pin 14, lock post 16, and retention pin 20 of FIGS. 1-2 above. Engagement of the retention pin with the receiver of the lock post may retain the lock post in the second bore. Diameters of the cylindrical second extension portion and the second bore may be chosen based on the desired torque requirement to rotate the lock post about the second longitudinal axis. The lock post may be operable to freely rotate between a locked state and an unlocked state without a bias toward either state.

In still other embodiments, a carriage assembly may include a body, a hinge pin, and a lock post. The body may include a first or lower surface. The lower surface may include a first bore and a cavity adjacent to the first bore. The cavity may include an inner surface having a projection. The hinge pin may include a shaft having a first longitudinal axis extending through the center of the shaft. The hinge pin may be at least partially disposed in the first bore. The lock post may include a base and a shaft adjacent to the base. The shaft may include a receiver. The lock post may be at least partially disposed in the cavity.

The projection of the inner surface of the cavity may engage the receiver of the lock post to retain the lock post in the cavity. In certain variations, by way of non-limiting example the receiver may be a circumferential groove or a partial circumferential groove.

The base of the lock post may engage the shaft of the hinge pin when the carriage assembly is in a locked state. Longitudinal movement of the hinge pin within the first bore may be restricted in a locked state. In certain embodiments, the engagement of the shaft of the hinge pin and the base of the lock post may restrict longitudinal movement of the hinge pin within the first bore. The lock post may be operable to rotate about the second longitudinal axis to disengage the base of the lock post from the shaft of the hinge pin to place the carriage assembly in an unlocked state. In an unlocked state, the hinge pin is free to move longitudinally within the first bore. The carriage assembly may be placed in an unlocked state by rotating the lock post about the second longitudinal axis to disengage the lock post from the hinge pin. In an unlocked state, the hinge pin is free to move longitudinally (e.g., vertically up and down) within the first bore. The hinge pin may be moved to a desired position (e.g., vertical height). The lock post may then be rotated to engage the hinge pin to return the carriage assembly to a locked state.

In other aspects, the present disclosure provides an adjustable height overhead carriage assembly for a vertically-hanging panel of a foldable barrier according to FIGS. 6A-10. Referring to FIGS. 6A-6B, a carriage assembly 110 includes a body 112, a hinge pin 114, and a lock post 116. Referring to FIG. 7, the body 112 may include a first or lower surface 122 and a second or side surface 124 that may be adjacent to the lower surface 122. In certain embodiments, the side surface 124 can be substantially perpendicular to the lower surface 122. A first bore 126 may be included in the lower surface 122. The first bore 126 may include female threads (not shown). A second bore or cavity 128 may further be included in the lower surface 122. The second bore 128 may comprise a third or inner surface 130. The second bore 128 may be a counterbore comprising a first portion 132 and a second portion 134. The first portion 132 has a first diameter and the second portion 134 has a second diameter. The first diameter may be larger than the second diameter. The lower surface 122 may further include a recess 140. The recess 140 may be adjacent to the first bore 126 and the second bore 128. The side surface 124 of the body 112 may include a third bore 142.

As shown in FIG. 8, the hinge pin 114 may include a first shaft 144, a threaded terminal end 146, and a first longitudinal axis 148 extending through the center of the first shaft 144. The threaded terminal end 146 may include male threads 149 and at least one longitudinal groove 150 that is substantially parallel to the first longitudinal axis 148. The at least one groove 150 may comprise a pair of opposed grooves. However, other numbers of groove are contemplated and are within the scope of the present disclosure. The threaded terminal end 146 of the hinge pin 114 may be at least partially disposed in the first bore 126. The male threads 149 of the threaded terminal end 146 may engage the female threads of the first bore 126 to retain the hinge pin 114 in the first bore 126.

The lock post 116 may include a base 152 comprising a first surface 154, a second surface 156, and a third surface 158. The first surface 154 may be adjacent to the second surface 156 and the third surface 158 (shown in FIGS. 6A-6B) may be adjacent to the first surface 154. In certain embodiments, the second surface 156 may be substantially perpendicular to the first surface 154, and the third surface 158 may be substantially perpendicular to the first surface 154 and substantially parallel to the second surface 156. The lock post 116 may include a pawl 160 extending from the first surface 154 of the base 152. The pawl 160 may be adjacent to the base 152. In certain embodiments, the pawl 160 may be integrally formed with the base 152.

The lock post 116 may further include a second shaft 166. In certain embodiments, the second shaft 166 may be substantially cylindrical. The second shaft second 166 may extend from the second surface 156 of the base 152, and be adjacent to and the base 152. In certain embodiments, the second shaft 166 may be integrally formed with the base 152. The second shaft 166 includes a second longitudinal axis 168 extending through its center. The second shaft 166 may include a fourth surface 170 and a receiver 172 provided in the fourth surface 170. In certain embodiments, the receiver 72 may comprise a circumferential first groove. In certain other embodiments, the receiver 72 may comprise a partial circumferential groove. The lock post 116 may further include a receptacle 174 (shown in FIGS. 6A-6B) in the third surface 158 of the base 152. The receptacle 174 may be a socket having a hexagonal cross section to receive a tool, such as a hex wrench, by way of non-limiting example. However, other shapes of receptacle and associated tools are contemplated and are within the scope of the present disclosure.

The carriage assembly 110 may optionally include a torsion spring (not shown), similar to the torsion spring 18 of FIGS. 2-4B. The torsion spring may have a fixed end and a free end. The torsion spring may be disposed around of second shaft 166 of the lock post 116.

The base 152 of the lock post 116 may be at least partially disposed in the first portion 132 of the second bore 128. The second shaft 166 of the lock post 116 may be at least partially disposed in the second portion 134 of the second bore 128. The pawl 160 may be at least partially disposed in the recess 140. The lock post 116 may be longitudinally-fixed within the second bore 138 and operable to rotate with respect to the second longitudinal axis 168.

The fixed end of the torsion spring may engage the inner surface 130 of the second bore 128. In certain embodiments, the inner surface 130 of the second bore 128 may include a second groove 182 to accommodate the fixed end of the torsion spring. The free end of the torsion spring may engage a wedge-shaped extension portion 184 extending from the first surface 154 of the base 152 of the lock post 116. In certain embodiments, the wedge-shaped extension portion 184 includes a third groove 186 to accommodate the free end of the torsion spring. The recess 140 of the base 112 may include a first portion 188 and a second portion 190. The pawl 160 may be at least partially disposed in the first portion 188 of the recess 140 and the wedge-shaped extension portion 184 may be at least partially disposed in the second portion 190 of the recess 140.

A retention pin (not shown) similar to the retention pin 20 of FIGS. 1-4B may be at least partially disposed in the third bore of the body. A first end (not shown) of the retention pin may engage the receiver 172 of the lock post 116 to retain the lock post 116 within the second bore 128.

The carriage assembly 110 may be provided in a locked state or an unlocked state. Returning to FIG. 6A, in the locked state, the pawl 160 of the lock post 116 engages the at least one groove 150 of the hinge pin 114, thereby impeding rotation of the hinge pin 114 about the first longitudinal axis 148 and fixing the longitudinal height of the hinge pin 114. The pawl 160 may be shaped to complement the groove 150. The torsion spring is in a free state when the carriage assembly 110 is in a locked state. Therefore, absent the application of torque to the lock post 116, the lock post 116 is biased toward the locked state.

Referring to FIG. 6B, the carriage assembly 110 can be placed in the unlocked state by rotation the lock post 116 about the second longitudinal axis 168. Rotation can be enabled by a tool (not shown) that can engage the receptacle 174 of the lock post 116. Rotation of the lock post 116 places the torsion spring in an energized state. Rotation of the lock post 116 disengages the pawl 160 of the lock post 116 from the groove 150 of the hinge pin 114. In the unlocked state, the hinge pin 114 is free to rotate about the first longitudinal axis 148. Such rotation allows longitudinal movement of the hinge pin 114 in the longitudinal direction within the first bore 126, thereby allowing respective vertical movement of the hinge and hanging panel to which the carriage assembly 110 is attached.

In certain other variations, a carriage assembly may be provided without a torsion spring. With reference to FIG. 10, a carriage assembly includes a body (not shown) similar to the body 112 of FIG. 7, a hinge pin 214 similar to the hinge pin 114 of FIG. 8, and a lock post 216 similar to the lock post 116 of FIG. 9. The hinge pin 214 includes at least one groove 218 similar to the groove 150 of FIG. 8. The groove 218 includes a back surface 220 and first and second side surfaces 222, 224. The back surface 220 forms a first angle 226 with the first side surface 222 and a second angle 228 with the second side surface 224. The first angle 226 and the second angle 228 may be the same or different Optionally, the first and second angles 226, 228 may each be acute The lock post 216 includes a pawl 240 similar to the pawl 160 of FIG. 9. The pawl 240 includes an end surface 242 and third and fourth side surfaces 244, 246. The end surface 242 forms a third angle 248 with the third side surface 244 and a fourth angle 250 with the fourth side surface 246. The third angle 248 and the fourth angle 250 may be the same or different. Optionally, the third angle 248 and the fourth angle 250 may each be acute. The pawl 240 of the lock post 216 engages the groove 218 of the hinge pin 214 to inhibit rotation of the hinge pin 214 in a locked state.

The third angle 248 may be the same as the first angle 226 and the fourth angle 250 may be the same as the second angle 228. When the angles 226, 228, 246, 248 are acute, slight rotation of the hinge pin 214 will drive the pawl 240 of the lock post 216 into the groove 218 of the hinge pin 214 to restrict rotation of the lock post 216 and bias the carriage assembly toward the locked state. More specifically, when a clockwise torque is applied to the hinge pin 214, the first surface 222 engages the third surface 244. When a counter-clockwise torque is applied to the hinge pin 214, the second surface 224 engages the fourth surface 246. Although FIG. 10 depicts the first, second, third, and fourth angles 226, 228, 248, 250 having substantially identical magnitudes, other geometries are contemplated within the scope of the present disclosure. For example, the first and third angles 226, 248 may be acute while the second and fourth angles 228, 250 are right angles, or the second and fourth angles 228, 250 may be acute while the first and third angles 226, 248 are right angles.

Referring to FIG. 11, in certain other variations, another carriage assembly 310 without a torsion spring is provided. The carriage assembly 310 includes a body 312 similar to the body 112 of FIG. 7, a hinge pin 314 similar to the hinge pin 114 of FIG. 8, and a lock post 316 similar to the lock post 116 of FIG. 9. The body 312 includes a recess 318 similar to the recess 140 of FIG. 7. The lock post 316 includes a wedge-shaped extension portion 320 similar to the wedge-shaped extension portion 184 of FIG. 9. The wedge-shaped extension portion 320 is at least partially disposed in the recess 318.

An interference is provided between the lock post 316 and the body 312 to prevent rotation of the lock post 316 when the carriage assembly 310 is in a locked state. The wedge-shaped extension portion 320 of the lock post 316 includes a protrusion 322 and the recess 318 of the body 312 includes a receptacle 324 having a shape that complements the protrusion 322. The protrusion 322 is operable to rotate into the receptacle 324 when the carriage assembly 310 goes from an unlocked state to a locked state. An inner surface 326 of the receptacle 324 includes at least one interference feature 328, which may be a pair of opposed raised portions. Other geometries of the body 312 and the lock post 316 that restrict rotation of the lock post 316 in a locked state are contemplated. For example, an interference fit may be provided between the protrusion 322 and the receptacle 324 without raised portions, the respective locations of the protrusion and receptacle may be reversed such that the receptacle is provided in the lock post and the protrusion is provided on the body, or raised portions may be provided on the protrusion rather than in the receptacle, by way of non-limiting example.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An adjustable carriage assembly for a vertically-hanging panel of a foldable barrier, the carriage assembly comprising:

a body comprising:

a lower surface;

a threaded first bore included in the lower surface;

a second bore included in the lower surface;

a recess included in the lower surface, wherein the recess is adjacent to the first bore and the second bore; and a side surface adjacent to the lower surface, the side surface including a third bore;

a hinge pin comprising a shaft, a threaded terminal end, and a first longitudinal axis extending through the center of the shaft, wherein the threaded terminal end comprises at least one flat portion substantially parallel to the first longitudinal axis;

a lock post comprising:

a base;

a first extension portion adjacent to the base; and a substantially cylindrical second extension portion comprising a second longitudinal axis extending through the center of the second extension portion, wherein the second extension portion is adjacent to and integrally formed with the base; and a receiver provided in an exterior surface of the second extension portion; and a retention pin;

wherein the second extension portion of the lock post is at least partially disposed in the second bore and the first extension portion of the lock post is at least partially disposed in the recess, wherein the threaded terminal end of the hinge pin is at least partially disposed in the first bore;

wherein the retention pin is at least partially disposed in the third bore, and a first end of the retention pin engages the receiver of the lock post to retain the lock post in the second bore;

wherein the first extension portion of the lock post engages the at least one flat portion of the hinge pin when the carriage assembly is in a locked state;

wherein the lock post is operable to rotate about the second longitudinal axis and rotation of the lock post disengages the first extension portion of the lock post from the at least one flat portion of the hinge pin to place the carriage assembly in an unlocked state; and wherein the hinge pin is free to rotate so as to move longitudinally within the first bore when the carriage assembly is in the unlocked state.

2. The carriage assembly of claim 1, wherein the receiver comprises a circumferential groove.

3. The carriage assembly of claim 1, further comprising a torsion spring disposed around the second extension portion of the lock post, the torsion spring comprising a fixed end and a free end, the fixed end engaging an inner surface of the second bore and the free end engaging the first extension portion of the lock post, wherein the torsion spring is in a free state when the carriage assembly is in a locked state, wherein rotation of the lock post about the second longitudinal axis energizes the torsion spring.

4. The carriage assembly of claim 3, wherein the inner surface of the second bore includes a groove, wherein the fixed end of the torsion spring engages the groove, wherein the fixed end of the torsion spring remains substantially fixed to the base during rotation of the lock post about the second longitudinal axis.

5. The carriage assembly of claim 3, wherein the first extension portion includes a groove, wherein the free end of the torsion spring engages the groove, wherein the free end of the torsion spring remains substantially fixed to the first extension portion during rotation of the lock post about the second longitudinal axis.

6. The carriage assembly of claim 1, wherein the second bore is a counterbore, the counterbore comprising a first portion having a first diameter and a second portion having a second diameter, wherein the first diameter is greater than the second diameter, wherein the second extension portion of the lock post is at least partially disposed in the second portion of the counterbore, the base of the lock post is at least partially disposed in the first portion of the counterbore, and the first extension portion of the lock post is at least partially disposed in the recess.

7. The carriage assembly of claim 6, wherein the base of the lock post comprises a first surface, a second surface substantially perpendicular to the first surface, and a third surface substantially perpendicular to the first surface and substantially parallel to the second surface, wherein the first extension portion extends from the first surface and the second extension portion extends from the second surface.

8. The carriage assembly of claim 7, wherein the third surface of the lock post includes a receptacle.

9. The carriage assembly of claim 8, wherein the receptacle comprises a socket having a hexagonal cross section.

10. The carriage assembly of claim 1, wherein the first extension portion comprises opposing side surfaces which form an angle.

11. The carriage assembly of claim 10, wherein the angle is greater than or equal to about forty-five (45) degrees and less than or equal to about ninety (90) degrees.

12. An adjustable carriage assembly for a vertically-hanging panel of a foldable barrier, the carriage assembly comprising:

a body comprising:
- a lower surface;
- a side surface adjacent to the lower surface;
- a threaded first bore included in the lower surface;
- a second bore included in the lower surface, wherein the second bore is a counterbore comprising and inner surface, a first portion having a first diameter, and a second portion having a second diameter;
- a recess included in the lower surface, wherein the recess is adjacent to the first bore and the second bore; and
- a third bore included in the side surface;

a hinge pin comprising a first shaft extending along a first longitudinal axis and a threaded terminal end, wherein the threaded terminal end comprises at least one flat portion substantially parallel to the first longitudinal axis;

a lock post comprising:
- a base comprising an extension portion and a receptacle comprising a socket having a hexagonal cross section;
- a second shaft extending along a second longitudinal axis and comprising a groove extending at least partially circumferentially around the second shaft;

a torsion spring having a fixed end and a free end; and a retention pin, wherein the torsion spring is disposed around the second shaft of the lock post;

wherein the base of the lock post is at least partially disposed in the first portion of the second bore and the second shaft is at least partially disposed in the second portion of the second bore, and the extension portion is disposed in the recess;

wherein the fixed end of the torsion spring engages the inner surface of the second bore and the free end of the torsion spring engages the extension portion of the lock post;

wherein the torsion spring is in a free state when the carriage assembly is in a locked state;

wherein the threaded terminal end of the hinge pin is at least partially disposed in the first bore;

wherein the retention pin is at least partially disposed in the third bore, and a first end of the retention pin engages the groove of the lock post to retain the lock post in the second bore;

wherein the extension portion of the lock post engages the at least one flat portion of the hinge pin when the carriage assembly is in the locked state;

wherein the lock post is operable to rotate about the second longitudinal axis and rotation of the lock post energizes the torsion spring and disengages the extension portion of the lock post from the at least one flat portion of the hinge pin to place the carriage assembly in an unlocked state; and wherein the hinge pin is free to rotate so as to move longitudinally within the first bore when the carriage assembly is in the unlocked state.

13. An adjustable carriage assembly for a vertically-hanging panel of a foldable barrier, the carriage assembly comprising:

a body comprising:
- a lower surface;
- a threaded first bore included in the lower surface;
- a second bore included in the lower surface;
- a recess included in the lower surface, wherein the recess is adjacent to the first bore and the second bore; and a hinge pin comprising a first shaft, a threaded terminal end, and a first longitudinal axis extending through the center of the first shaft, wherein the threaded terminal end comprises at least one groove substantially parallel to the first longitudinal axis;

a lock post comprising a base comprising a pawl and a second shaft comprising a second longitudinal axis extending through the center of the second shaft, wherein the second shaft is adjacent to the base; and wherein the second shaft of the lock post is at least partially disposed in the second bore, the pawl is at least partially disposed in the recess, and the lock post is longitudinally fixed within the second bore;

wherein the threaded terminal end of the hinge pin is at least partially disposed in the first bore;

wherein the pawl of the lock post engages the groove of the hinge pin when the carriage assembly is in a locked state;

wherein the lock post is operable to rotate about the second longitudinal axis and rotation of the lock post disengages the pawl of the lock post from the groove of the hinge pin to place the carriage assembly in an unlocked state; and wherein the hinge pin is free to rotate so as to move longitudinally within the first bore when the carriage assembly is in the unlocked state.

14. The carriage assembly of claim 13, further comprising a torsion spring disposed around the second shaft of the lock post, the torsion spring comprising a fixed end and a free end, the fixed end engaging an inner surface of the second bore and the free end engaging the lock post, wherein the torsion spring is in a free state when the carriage assembly is in a locked state, wherein rotation of the lock post about the second longitudinal axis energizes the torsion spring.

15. The carriage assembly of claim 14, wherein the lock post further comprises an extension portion and the free end of the torsion spring engages the extension portion of the lock post.

16. The carriage assembly of claim 14, wherein the pawl of the lock post is shaped to complement the groove of the hinge pin.

17. The carriage assembly of claim 13, wherein:

the groove includes a back surface, a first side surface adjacent to the back surface, and a second side surface adjacent to the back surface;

the back surface and the first side surface form a first angle the back surface and the second side surface form a second angle;

the pawl comprises an end surface, a third side surface adjacent to the end surface operable to engage the first side surface, and a fourth side surface adjacent to the end surface operable to engage the second side surface;

the end surface and the third side surface form a third angle;

the end surface and the fourth side surface form a fourth angle; and the first angle and the third angle are acute.

18. The carriage assembly of claim 17, wherein the second angle is acute and the fourth angle is acute.

19. The carriage assembly of claim 17, wherein the magnitude of the first angle is substantially equal to the magnitude of the third angle and the first surface and the third surface are substantially parallel when the carriage assembly is in the locked state.

20. The carriage assembly of claim 13, further comprising a retention pin at least partially disposed in a third bore of a side surface of the body adjacent to the lower surface, wherein the retention pin engages a receiver of the lock post to retain the lock post in the second bore.

21. The carriage assembly of claim 13, wherein:

the base of the lock post further comprises an extension portion including a protrusion;

the recess of the base includes a receptacle shaped to complement the protrusion; and the protrusion is operable to engage the receptacle when the carriage assembly is in the locked state.

22. The carriage assembly of claim 21, wherein one of the protrusion or the receptacle includes at least one raised portion and the at least one raised portion is operable to create an interference fit between the protrusion and the receptacle when the carriage assembly is in the locked state.

* * * * *